US006143457A

United States Patent [19]

Carlini et al.

[11] Patent Number: 6,143,457

[45] Date of Patent: Nov. 7, 2000

[54] TONER COMPOSITIONS

[75] Inventors: Rina Carlini, Mississauga; Guerino G. Sacripante, Oakville; Richard P. N. Veregin, Mississauga, all of Canada

[73] Assignee: Xerox Corporation, Stamford, Conn.

[21] Appl. No.: 09/415,074

[22] Filed: Oct. 12, 1999

[51] Int. Cl.[7] ..... G03G 9/097

[52] U.S. Cl. ..... 430/110; 430/137

[58] Field of Search ..... 430/110, 137

[56] References Cited

U.S. PATENT DOCUMENTS

| | | | |
|---|---|---|---|
| 3,590,000 | 6/1971 | Palermiti et al. | 430/110 |
| 4,560,635 | 12/1985 | Hoffend et al. | 430/106.6 |
| 4,621,039 | 11/1986 | Ciccarelli et al. | 430/106 |
| 4,752,550 | 6/1988 | Barbetta et al. | 430/106.6 |
| 4,937,157 | 6/1990 | Haack et al. | 430/110 |
| 4,954,412 | 9/1990 | Breton et al. | 430/137 |
| 5,348,832 | 9/1994 | Sacripante et al. | 430/109 |
| 5,593,807 | 1/1997 | Sacripante et al. | 430/137 |
| 5,604,076 | 2/1997 | Patel et al. | 430/137 |
| 5,648,193 | 7/1997 | Patel et al. | 430/137 |
| 5,658,704 | 8/1997 | Patel et al. | 430/137 |
| 5,660,965 | 8/1997 | Mychajlowskij et al. | 430/137 |
| 5,840,462 | 11/1998 | Foucher et al. | 430/137 |
| 5,843,614 | 12/1998 | Shinzo et al. | 430/137 |
| 5,853,944 | 12/1998 | Foucher et al. | 430/137 |
| 5,916,725 | 6/1999 | Patel et al. | 430/137 |

*Primary Examiner*—Roland Martin
*Attorney, Agent, or Firm*—E. O. Palazzo

[57] ABSTRACT

A toner comprised of a sulfonated polyester resin, colorant and thereover a quaternary organic component ionically bound to the toner surface.

33 Claims, No Drawings

TONER COMPOSITIONS

The present invention is generally directed to toner compositions and processes thereof, and more specifically, the present invention relates to a toner comprised of a sulfonated polyester resin, and colorant, and wherein the toner, especially the surface thereof, is comprised of tetra-alkylated quatemary ammonium salts or tetra-alkylated quatemary phosphonium salts of sulfonated polyester groups bound or attached on the toner surface. More specifically, the present invention is directed to toner compositions and processes thereof, wherein the surface layer of the toner is comprised of a linear sulfonated polyester resin, rendered hydrophobic by a wet chemical surface treatment with aqueous solutions of various quatemary ammonium and/or phosphonium salts thereby, for example, enhancing the surface charging performance of the toner particles enabling high triboelectric charge levels at 20 percent RH (Relative Humidity), and 80 percent RH in the range of from about −30 to about −90 microcoulombs per gram, and about −20 to about −40 microcoulombs per gram, respectively; a low relative humidity sensitivity, such as from about 1.1 to about 2.8; and low melt fusing and high gloss properties. Furthermore, the present invention relates to the coalescence or fusion of colorant and resin particles, especially colloidal particles comprised of a sodio-sulfonated linear polyester dissipated in water, of average polyester particle size for example, of from about 5 to about 80 nanometers, and preferably from about 10 to about 40 nanometers as determined by a Nicomp particle sizer. In embodiments, the present invention is directed to the economical in situ, chemical or direct preparation of toners comprised of a sulfonated polyester resin, colorant, and a toner surface layer comprised of ionic complexes formed between the anionic sulfonate groups of the polyester resin and quaternary ammonium and/or phosphonium cations, reference Formula 1 herein, and wherein the alkyl substituents of such ions can include (i) C1 to C18 alkyl groups such as methyl, ethyl, propyl, butyl, decyl, stearyl and the like; (ii) C6 to C18 aryl substituents, such as phenyl, naphthyl, phenanthryl, anthracenyl, fluorenyl and the like; (iii) aryl-alkyl substituents of the general formula $C_6H_5(CH_2)_n$— containing both an aryl group and methylene spacer groups such as $(CH_2)_n$, where n=0 to 5, such as phenyl, benzyl, 2-phenylethyl, 3-phenylpropyl and the like.

Formula 1:

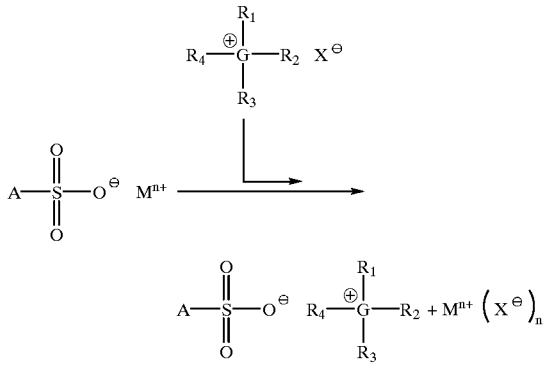

wherein A is a toner of a sulfonated polyester and colorant; G is nitrogen or phosphorus, and where $R_1$, $R_2$, $R_3$, $R_4$ are each independently alkyl, such as $CH_3(CH_2)_n$—; wherein n represents the number of segments or groups, and is, for example, a number of from 0 to about 20; or wherein $R_1$, $R_2$, $R_3$, $R_4$ is $C_6H_5(CH_2)_n$ wherein n represents the number of segments, and is, for example, from 1 to about 5, or wherein $R_1$, $R_2$, $R_3$, $R_4$ are aryl; X is a halide (F, Cl, Br, I), acetate $CH_3CO_2^-$, $HSO_4^-$, or $H_2PO_4^-$; and $M^{n+}$ is a metal ion such as $Na^+$, $Zn^{2+}$, $Al^{3+}$, $Mg^{2+}$, $Ca^{2+}$, $Cu^{2+}$, $Ba^{2+}$, and the like.

In a specific embodiment of the present invention there is provided a toner composition comprised of (i) a sulfonated polyester core, obtained, for example, by the coalescence of a colorant and a colloidal aqueous solution comprised of about 10 to about 20 percent solids of sodio-sulfonated polyester resin particles, generated with a coalescence agent comprised of, for example, the halide (fluoride, chloride, bromide, iodide), acetate, sulfate, phosphate or alkylate salt of divalent Group II elements, such as magnesium, calcium, beryllium, barium, or the analogous salts of the transition metals of Groups III to XII, such as for example zinc, copper, cadmium, manganese, vanadium, iron, cobalt, chromium, niobium, zirconium, nickel and the like; and (ii) a surface layer of sulfonated (or sodio-sulfonated) polyester which is chemically treated with a heated aqueous solution of tetra-alkylated quatemary ammonium and/or phosphonium halide (fluoride, chloride, bromide, iodide), acetate, sulfate, phosphate, or alkylate salt, such that the final concentration of the quatemary ammonium and/or phosphonium salt is in the range amount of from about 0.1 to about 5.0 weight percent of toner solids, and typically is in the range amount of about 1.0 to about 3.0 weight percent of toner solids. The aforementioned in situ surface treatment selectively targets and directs the hydrophilic and RH sensitive metal-complexed sulfonate groups to the toner surface by causing an ion exchange of the complexed metal ion, which can be an alkali metal ion from Group I, for example lithium, sodium, potassium and the like, alkaline earth metal ion from Group II, for example magnesium, calcium, beryllium, the barium salts of chloride, bromide, iodide, acetate, or alkylate, or any transition metal ion of Groups III to XII, for example zinc, copper, cadmium, manganese, vanadium, iron, cobalt, chromium, niobium, zirconium, nickel and the like, for a quatemary ammonium or phosphonium ion thereby, for example, rendering the toner surface more hydrophobic and less hygroscopic. The resulting surface treated toner particles display in embodiments enhanced triboelectric charging levels, especially in the higher 80 percent relative humidity zone, and lower RH sensitivity of charging performance between the 20 percent relative humidity zone and 80 percent relative humidity zone without compromising the low-melt toner fusing properties, and with toner minimum fusing temperatures of from about 125° C. to about 140° C. determined at a crease area of about 60 units, and high gloss characteristics with peak gloss levels in the range of from about 40 to about 70 gloss units, as measured with a Gardner gloss meter, when compared to the nonsurface treated toners of the same composition. In embodiments, the toner composites or compositions of the present invention display: (i) an average volume diameter of, for example, from about 1 to about 25, and preferably from 1 to about 10 microns and a narrow GSD of, for example, from about 1.16 to about 1.26 or about 1.18 to about 1.28 as measured on the Coulter Counter; (ii) a particle morphology which is nearly spherical in shape; (iii) high triboelectric charge levels at 20 percent RH and 80 percent RH in the range of from about −30 to about −90 microcoulombs per gram, and about −20 to about −40 microcoulombs per gram, respectively, as compared with the same nonsurface treated toner; (iv) lower RH sensitivity, as expressed in the 20 percent RH to 80 percent RH ratio of charge-to-mass values, of from about 1.3 to 3, when compared to a treated toner; (v) low fusing temperatures, for example, of from about 110° C. to about 145° C., corresponding to a crease area of 60 units; (vi) high gloss levels of a fused image, for example, of from about 60 to 70 gloss units, as measured on a Gardner gloss meter; and (vii) low or no vinyl offset, of from about 0.03 to about 0.11 percent, measured as the percentage of toner mass from a fused image transferred onto a MYLAR® sheet over a period of 48 hours at 50° C. The process of the present invention in embodiments enables the utilization of polymers obtained by polycondensation reactions, such polymers including, for example, polyesters, and more specifically, the sulfonated polyesters as illustrated in U.S. Pat. Nos. 5,348,832; 5,658,704 and 5,604,076, the disclosures of which are totally incorporated herein by reference, and which polyesters may be selected for low melting toners.

The toners of the present invention can be selected for known electrophotographic imaging methods, printing processes, including color processes, digital methods, and lithography.

PRIOR ART

Patents which disclose the use of quaternary ammonium salts as toner charge control additives are U.S. Pat. Nos. 4,621,039; 4,560,635 (and Re. 32,883); 4,937,157; 4,752,550, the disclosure of which is totally incorporated herein by reference. There is illustrated in U.S. Pat. No. 4,954,412, the disclosure of which is totally incorporated herein by reference, a microsuspension process for the preparation of encapsulated toner compositions, comprised of an olefinic polymer core and a shell comprised of a thermotropic liquid crystalline polyester resin.

Polyester based chemical toners substantially free of encapsulation are also known, reference U.S. Pat. No. 5,593,807, the disclosure of which is totally incorporated herein by reference, wherein there is disclosed a process for the preparation of a toner comprised of a sodio sulfonated polyester resin and pigment, and wherein the aggregation and coalescence of resin particles is mediated with an alkali halide. Other U.S. Patents that may be of interest, the disclosures of which are totally incorporated herein by reference are U.S. Pat. Nos. 5,853,944; 5,843,614; 5,840,462; 5,604,076; 5,648,193; 5,658,704 and 5,660,965.

The appropriate processes and components of the above patents may be selected for the present invention in embodiments thereof.

SUMMARY OF THE INVENTION

It is a feature of the present invention to provide dry toner compositions comprised of a sulfonated polyester resin and colorant, and a toner surface layer composed of quaternary tetra-alkylated ammonium salts or quaternary tetra-alkylated phosphonium salts that are selectively and ionically complexed to the surface sulfonated groups of the polyester core.

In another feature of the present invention there are provided simple and economical chemical processes for the preparation of toner compositions with, for example, a polyester core with incorporated colorant and a surface layer or shell thereover of quaternary tetra-alkylated ammonium or phosphonium salts.

In a further feature of the present invention there is provided surface-treated toner particles with enhanced charging performance characteristics such as triboelectric charging levels at both low and high humidity zones (20 percent and 80 percent relative humidity, respectively), minimized RH sensitivity, and narrow charge distributions determined by the half-width of the charge spectrograph.

Additionally, in another feature of the present invention there are provided surface-treated toners with ionically complexed tetra-alkylated ammonium or phosphonium salts, and which toners exhibit excellent aging characteristics as compared to the same or similar nonsurface treated toners comprised of the same sulfonated polyester resin core.

Also, in another feature of the present invention there is provided surface-treated toner particles with excellent fusing characteristics for digital color printing applications, low fusing temperatures of from about 130° C. to about 150° C., high gloss performance measuring greater than about 60, such as from about 60 to about 90, gloss units as measured on a Gardner gloss metering unit, and low vinyl offset, as compared to the same or similar nonsurface treated toners.

In a further feature of the present invention there is provided a simple sequential, such as a stepwise process for the preparation of toner size particles in the size range of from about 3 to about 10 microns with a narrow GSD in the range of from about 1.18 to about 1.26, and wherein the toner is chemically surface-treated by heating at temperatures of about 40° C. to about 60° C. with aqueous solutions of a halide (fluoride, chloride, bromide, iodide), acetate, sulfate or phosphate salts of tetra-alkylated ammonium cations and/or tetra-alkylated phosphonium cations, as illustrated in Formula 1.

Moreover, in another feature of the present invention there is provided a process for the preparation of toner compositions, which possess observable spherical morphology, nonspherical morphology or mixtures thereof, with an average particle volume diameter of from between about 1 to about 20 microns, and preferably from about 1 to about 9 microns, and with a narrow GSD of from about 1.12 to about 1.30, and preferably from about 1.14 to about 1.25 as measured by a Coulter Counter.

In yet another feature of the present invention there are provided toner compositions with low fusing temperatures of from about 110° C. to about 130° C. and with excellent blocking characteristics of from about 50° C. to about 60° C., and preferably from about 55° C. to about 60° C.

Moreover, in another feature of the present invention there are provided toner compositions with a high projection efficiency, such as from about 75 to about 95 percent efficiency as measured by the Match Scan II spectrophotometer available from Milton-Roy.

In a further feature of the present invention there are provided toner compositions which result in minimal, low or no paper curl.

Aspects of the present invention relate to a toner comprised of a sulfonated polyester resin, colorant, and thereover a quatemary organic component, especially a cation, ionically bound to the toner surface, that is for example ionically attached to the sulfonated polyester; a toner wherein the quaternary organic component is a cation of a tetra-alkylated ammonium salt or a tetra-alkylated phosphonium salt; a toner wherein the polyester is of the formula

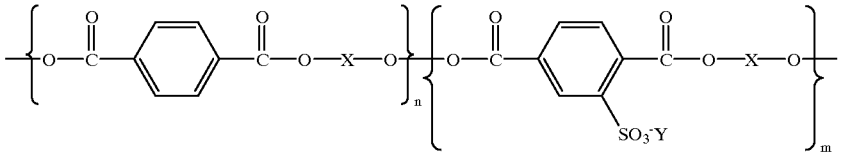

wherein Y is an alkali metal, X is a glycol, and n and m each represent the number of segments; a toner wherein the quatemary component is a tetra-alkylated ammonium salt of benzyldimethyl-stearylammonium chloride or dimethyldistearylammonium bromide; a toner wherein the quaternary component is a tetra-alkylated phosphonium of stearyltributyl phosphonium bromide or tetraphenyl phosphonium bromide; a toner wherein the Y alkali is magnesium; a toner wherein the Y metal is zinc; a toner wherein the colorant is a cyan, black, magenta, yellow dispersion or mixtures thereof with from about 20 to about 60 weight percent of colorant solids; a toner wherein the colorant is carbon black; a toner wherein the colorant is a dye; a toner wherein the colorant is a pigment; a toner wherein the colorant is comprised of cyan, yellow, magenta, black, green, orange, violet or brown, and wherein each colorant is present in an amount of from about 2 weight percent to about 20 weight percent of the toner; a toner wherein the toner contains blended dry powder additives on the toner surface, and which additives are comprised of metal salts, metal salts of fatty acids, colloidal silicas, metal oxides, or mixtures thereof, and which additives are each optionally present in an amount of from about 0.1 to about 2 weight percent; a toner wherein the X glycol is an aliphatic glycol of neopentyl glycol, ethylene glycol, propylene glycol, butylene glycol, pentylene glycol, propanediol, 1,2-propanediol, diethylene glycol, dipropylene glycol, or mixtures thereof; and n and m each represent a number of from about 10 to about 30, and wherein the weight average molecular weight of the polyester is from about 2,000 grams per mole to about 100,000 grams per mole, the number average molecular weight is from about 1,000 grams per mole to about 50,000 grams per mole, and the polydispersity thereof is from about 2 to about 18 as measured by gel permeation chromatography; a toner process comprising (i) preparing a colloidal solution of a sulfonated polyester resin by heating water at a temperature of from about 75° C. to about 95° C., adding thereto a sulfonated polyester resin, and cooling; (ii) adding thereto a colorant, followed by heating the resulting mixture to a temperature equal to or higher than the resin glass transition temperature; (iii) adding thereto an aqueous solution of either an alkaline earth metal (II) salt or a transition metal salt whereby the coalescence and ionic complexation of sulfonated polyester colloid, colorant, and metal cation occur until the particle size of the composite is about 3 to about 10 microns in volume-average diameter with a geometric distribution of from about 1.13 to about 1.23, wherein the wet toner solids of about 3 to about 10 microns in size are redispersed in water forming a slurry of about 15 to about 25 percent by weight of toner solids; (iv) followed by chemically treating toner particles in the heated aqueous slurry at temperatures of about 25° C. to about 60° C. with an aqueous solution containing about 0.1 to about 5 percent by weight of toner of a tetra-alkylated ammonium or tetra-alkylated phosphonium salt; a process wherein the toner is isolated, filtered, washed with water, and dried; a toner wherein the polyester is present in an amount of from about 80 to about 98 percent by weight of the toner, the colorant is present from an amount of from about 2 to about 20 weight percent of the toner, and the quaternary organic component is present in an amount of from about 0.1 to about 5 weight percent of the toner; a toner wherein the quatemary component is a salt and forms a surface layer on the resin and the colorant; a toner wherein the surface layer is of a thickness of from about 0.01 to about 0.2 micron; a toner wherein the polyester resin contains from about 0.1 to about 5.0 weight percent of sulfonated groups; a toner wherein the tetra-alkylated phosphonium is of the formula

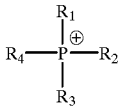

wherein $R_1$, $R_2$, $R_3$, and $R_4$ are each independently alkyl or aryl; a toner wherein the tetra-alkylated ammonium is of the formula

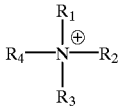

wherein $R_1$, $R_2$, $R_3$, and $R_4$ are independently alkyl or aryl; a toner wherein the salt is stearyltributylphosphonium bromide, tetraphenylphosphonium bromide, distearyldibutylphosphonium bromide, stearyltriethyl phosphonium bromide or butyltriphenylphosphonium bromide; a toner wherein the salt is benzyldimethylstearylammonium chloride, stearyltributylammonium bromide, tetraphenylammonium bromide, distearyldimethylammonium bromide, stearyltriethylammonium bromide or butyltriphenylphosphonium bromide; a toner wherein the salt is present in an amount of from about 0.1 to about 5 weight percent of the toner; a toner wherein the salt is present in an amount of from about 0.1 to about 5 weight percent of the toner; a toner wherein the salt primarily functions to enhance the triboelectric charge and reduce the toner relative humidity sensitivity; a toner comprised of a polyester resin, colorant and a quaternary organic cation; a toner wherein the polyester is a sodiosulfonated polyester; a toner wherein the organic component cation is chemically attached to the toner surface; a toner comprised of a resin, colorant and a quatemary organic cation; a toner wherein the organic component cation is comprised of the halide salts of ammonium or phosphonium salts; a toner comprised of a colorant and a polyester quaternary cation of the formula

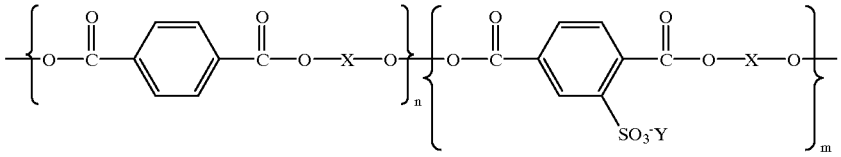

wherein Y is

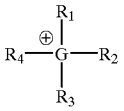

wherein each R is alkyl or aryl; G is nitrogen or phosphorus; X is a glycol or is generated from glycol; and m and n represent the number of segments; a toner comprised of a metal-complexed sulfonated polyester resin, colorant and a layer comprised of ionic complexes formed between the anionic sulfonate groups on the metal complexed polyester resin and tetra-alkylated ammonium and/or phosphonium cations. The metal-complexed sulfonated polyester resin core of the toner is, for example, of the formula

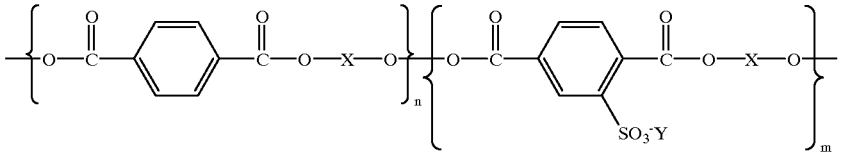

wherein Y is a monovalent alkali Group metal ion, for example lithium, sodium, and potassium, a divalent alkaline earth Group II metal ion, for example beryllium, magnesium, calcium, and barium, or Y is a multivalent transition metal ion, for example scandium, yttrium, lanthanides, titanium, zirconium, hafnium, vanadium, chromium, niobium, tantalum, molybdenum, tungsten, manganese, rhenium, iron, ruthenium, osmium, cobalt, rhodium, iridium, nickel, palladium, copper, platinum, silver, gold, zinc, cadmium, mercury, aluminum, or mixtures thereof, and X represents alkyl groups of a glycol monomer, wherein the glycol is neopentyl glycol, ethylene glycol, propylene glycol, butylene glycol, diethylene glycol, dipropylene glycol, or mixtures thereof, and n and m represent the number of segments, and more specifically, wherein n and m represent a number of about 10 to about 30 each, and wherein the weight average molecular weight of the polyester is from about 2,000 grams per mole to about 100,000 grams per mole, the number average molecular weight is from about 1,000 grams per mole to about 50,000 grams per mole, and the polydispersity thereof is from about 2 to about 18 as measured by gel permeation chromatography. The toner core resin can be the magnesium salt of copoly (1,2-propylene-dipropylene-5-sulfoisophthalate)-copoly (1,2-propylene-dipropylene terephthalate), the magnesium salt of copoly (1,2-propylene-diethylene-5-sulfoisophthalate)-copoly (1,2-propylene-diethylene terephthalate), the calcium salt of copoly (1,2-propylene-dipropylene-5-sulfoisophthalate)-copoly (1,2-propylene-dipropylene terephthalate), the calcium salt of copoly (1,2-propylene-diethylene-5-sulfoisophthalate)-copoly (1,2-propylene-diethylene terephthalate), the barium salt of copoly (1,2-propylene-diethylene-5-sulfoisophthalate)-copoly (1,2-propylene-diethylene terephthalate); the barium salt of copoly (1,2-propylene-dipropylene-5-sulfoisophthalate)-copoly (1,2-propylene-dipropylene terephthalate); the zinc salt of copoly (1,2-propylene-diethylene-5-sulfoisophthalate)-copoly (1,2-propylene-diethylene terephthalate), the zinc salt of copoly (1,2-propylene-dipropylene-5-sulfoisophthalate)-copoly (1,2-propylene-dipropylene terephthalate), the vanadium salt of copoly (1,2-propylene-dipropylene-5-sulfoisophthalate)-copoly (1,2-propylene-dipropylene terephthalate); the vanadium salt of copoly (1,2-propylene-diethylene-5-sulfoisophthalate)-copoly (1,2-propylene-diethylene terephthalate); the copper salt of copoly (1,2-propylene-dipropylene-5-sulfoisophthalate)-copoly (1,2-propylene-dipropylene terephthalate); or the copper salt of copoly (1,2-propylene-diethylene-5-sulfoisophthalate)-copoly (1,2-propylene-diethylene terephthalate).

The surface of the toner can be represented by the general formula illustrated in Scheme 3, where Y is a tetra-alkylated ammonium or an alkylated phosphonium cation and wherein G is nitrogen or phosphorus, and the like, and the substituents $R_1$, $R_2$, $R_3$, and $R_4$ are aliphatic, such as either C1 to C18 (with from 1 to about 18 carbon atoms) alkyl groups, for example methyl, ethyl, propyl, butyl, decyl, stearyl and the like; Y is a monovalent alkali Group I metal ion $M^{n+}$, for example lithium, sodium, and potassium; Y is a divalent alkaline earth Group II metal ion, for example beryllium, magnesium, calcium, and barium, Y is a multivalent transition metal ion, for example scandium, yttrium, lanthanides, titanium, zirconium, hafnium, vanadium, chromium, niobium, tantalum, molybdenum, tungsten, manganese, rhenium, iron, ruthenium, osmium, cobalt, rhodium, iridium, nickel, palladium, copper, platinum, silver, gold, zinc, cadmium, mercury, aluminum, or mixtures thereof. The substituent X can represent alkyl groups generated from a glycol monomer, wherein the glycol is neopentyl glycol, ethylene glycol, propylene glycol, butylene glycol, diethylene glycol, dipropylene glycol, or mixtures thereof, and n and m represent the number of segments.

The present invention also relates to a toner wherein the resin surface layer is a tetra-alkylated ammonium or tetra-alkylated phosphonium salt of a resin comprised of copoly (1,2-propylene-dipropylene-5-sulfoisophthalate)-copoly (1,2-propylene-dipropylene terephthalate), or copoly (1,2-propylene-diethylene-5-sulfoisophthalate)-copoly (1,2-propylene-diethylene terephthalate), or copoly (1,2-dipropylene-diethylene-5-sulfoisophthalate)-copoly (1,2-dipropylene-diethylene terephthalate), or mixtures thereof; a toner wherein segments n and m represent about 10 to about 30 each, and wherein the weight average molecular weight of the polyester is from about 2,000 grams per mole to about 100,000 grams per mole, the number average molecular weight is from about 1,000 grams per mole to about 50,000 grams per mole, and the polydispersity thereof is from about 2 to about 18 as measured by gel permeation chromatography.

Scheme 3:

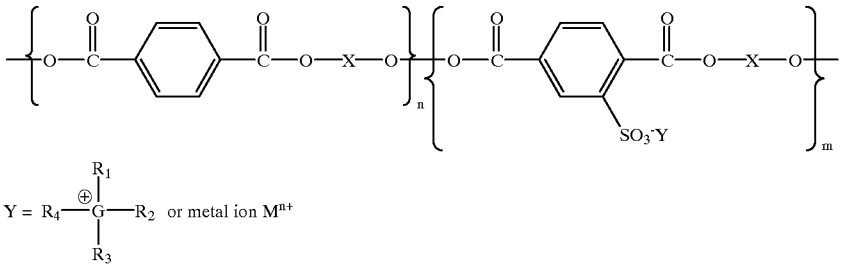

wherein the substituents, such as R, G, N, n, m, and P are as illustrated herein.

Furthermore, the present invention relates to a toner wherein the colorant is a cyan, black, magenta, yellow dispersion or mixtures thereof with from about 20 to about 60 weight percent solids of resin and colorant; a toner wherein the colorant is carbon black; a toner wherein the colorant is a dye; a toner wherein the colorant is a pigment; a toner wherein the colorant is comprised of a mixture of a pigment and a dye; and a toner which contains surface additives comprised of metal salts, metal salts of fatty acids, colloidal silicas, metal oxides, or mixtures thereof which additives are each optionally present in an amount of from about 0.1 to about 2 weight percent.

The process of the present invention comprises, for example, (i) mixing a colloidal solution of a sodio-sulfonated polyester resin with a particle size of from about 10 to about 80 nanometers, and preferably from about 10 to about 40 nanometers, and colorant; (ii) adding thereto an aqueous solution containing about 1 to about 10 percent by weight in water at neutral pH of a coalescence agent comprised of an ionic salt of the Group II or Group XIII metals or the transition metals of Groups II to XII, such as for example, the halide (fluoride, chloride, bromide, iodide), acetate, or sulfate salts of zinc, copper, cadmium, manganese, vanadium, nickel, niobium, chromium, iron, zirconium, scandium and the like; (iii) optionally cooling and optionally adding to the toner composition formed wax, charge additive, and surface flow additives; (iv) isolating, filtering, washing the toner, and optionally drying; (v) and optionally wherein the wet toner solids are redispersed in water and chemically treated at elevated temperatures of from about 40° C. to about 56° C. with an aqueous solution containing about 0.1 about 5.0 percent by weight of toner of a tetra-alkylated ammonium or tetra-alkylated phosphonium salt; and (vi) isolating the chemically surface-treated toner, filtering and washing with water, and drying the toner.

In embodiments the present invention relates to a toner comprised of a sulfonated polyester resin and colorant, and wherein the toner is prepared by (i) generating a colloidal solution of a sodio-sulfonated polyester resin, present for example, in an amount of about 300 grams in 2 liters of water by heating the mixture at, for example, from about 20° C. to about 40° C. above the polyester polymer glass transition, thereby forming a colloidal solution of submicron particles in the size range of, for example, from about 10 to about 70 nanometers; (ii) adding thereto a colorant such as Pigment Blue 15:3, available from Sun Chemicals, in an amount of, for example, from about 3 to about 5 percent by weight of toner; (iii) heating the resulting mixture to a temperature of from about 50° C. to about 60° C., and adding thereto an aqueous solution of an metal salt, such as zinc acetate, for example, at 5 percent by weight in water, at a rate of from about 1 to about 2 milliliters per minute, whereby the coalescence and ionic complexation of sulfonated polyester colloid and colorant occur until the particle size of the core composite is, for example, from about 3 to about 6 microns in diameter (volume average throughout unless otherwise indicated or inferred) with a i geometric distribution of from about 1.13 to about 1.23 as measured by a Coulter Counter; (iv) cooling the reaction mixture to about room temperature, filtering, washing with water and drying to provide a toner comprised of a sulfonated polyester resin and colorant and wherein the particle size of the toner composite is, for example, from about 3 to about 6 microns in diameter with a geometric distribution of from about 1.13 to about 1.23 as measured by the Coulter Counter. The present invention also provides a method for the chemical surface treatment of toner particles with about 0.5 percent by weight of a tetra-alkylated ammonium or phosphonium salt, such as for example stearyltributylphosphonium bromide, wherein about 100 grams of the wet toner composite particles are dispersed in about 0.5 liter of water to obtain a slurry containing, for example about 20 percent by weight of toner solids. The toner slurry can then be gently stirred and heated to a temperature of from about 40° C. to about 55° C., and typically from about 48° C. to about 52° C., after which about 50 milliliters of an aqueous solution of about 1 to about 5 percent by weight of stearyltributylphosphonium bromide is added slowly at a rate of about 0.5 to about 1.0 milliliter per minute. The treated toner slurry is then subsequently stirred for about 30 to about 60 additional minutes followed by cooling to room temperature, sieving and filtering, washing with water and drying to provide a toner comprised of a core of sulfonated polyester resin and colorant and a surface layer of sulfonated polyester ionically complexed with tetra-alkylated ammonium or phosphonium salts, and wherein the particle size of the toner composite is from about 3 to about 10 microns in diameter with a geometric distribution of from about 1.10 to about 1.25 as measured by the Coulter Counter.

The polyester is preferably a sodio sulfonated polyester resin as illustrated in, for example, U.S. Pat. Nos. 5,348,832; 5,853,944; 5,840,462; 5,660,965; 5,658,704; 5,648,193; and 5,593,807, the disclosures of each patent being totally incorporated herein by reference.

Examples of the alkali (II) salts that can be selected to primarily coalesce the generated sodio sulfonated polyester colloid with a colorant to enable the formation of the core composite are preferably selected from the akali (II) groups such as beryllium chloride, beryllium bromide, beryllium iodide, beryllium acetate, beryllium sulfate, magnesium chloride, magnesium bromide, magnesium iodide, magnesium acetate, magnesium sulfate, calcium chloride, calcium bromide, calcium iodide, calcium acetate, calcium sulfate, strontium chloride, strontium bromide, strontium iodide, strontium acetate, strontium sulfate, barium chloride, barium bromide, barium iodide, or mixtures thereof, and the concentration thereof is in the range of, for example, from about 0.1 to about 5 weight percent of water. It is believed that the divalent alkali (II) metal ion exchanges with the monovalent sodium ion of the sulfonated polyester resin colloid, thus coalescing the colloidal particles, and wherein the core polyester resin is

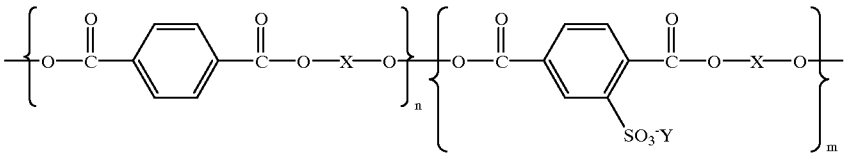

wherein Y is an alkaline earth (II) metal, such as a magnesium ($Mg^{2+}$), beryllium ($Be^{2+}$), calcium ($Ca^{2+}$); X is a glycol, such as an aliphatic glycol, or a mixture of glycols, such as neopentyl glycol, ethylene glycol, propylene glycol, butylene glycol, pentylene glycol, propanediol, especially 1,2-propanediol, diethylene glycol, or mixtures thereof; and n and m represent the number of segments, and more specifically, wherein n and m are each from about 10 to about 30 each, and wherein the weight average molecular weight thereof is from about 2,000 grams per mole to about 100,000 grams per mole, the number average molecular weight is from about 1,000 grams per mole to about 50,000 grams per mole, and the polydispersity is from about 2 to about 18 as measured by gel permeation chromatography.

Examples of transition metal salts that can be selected to coalesce the sodio sulfonated polyester colloid to form the polyester resin shell, are preferably the halides such as chloride, bromide, iodide, or anions such as acetates, acetoacetates, sulfates of vanadium, niobium, tantalum, chromium, molybdenum, tungsten, manganese, iron, ruthenium, cobalt, nickel, copper, zinc, cadmium, silver; aluminum salts such as aluminum acetate, aluminum polyaluminum chloride, aluminum halides, mixture thereof and the like, and wherein the concentration thereof is optionally in the range of from about 0.1 to about 5 weight percent by weight of water. It is believed, while not desired to be limited by theory, throughout that the transition metal ion exchanges with the monovalent sodium ion of the sulfonated polyester resin colloid, thus coalescing the colloidal particles, and wherein the formula of the second polyester shell resin is as illustrated herein, and wherein Y is preferably zinc ($Zn^{2+}$), vanadium ($V^{3+}$), or multivalent ions of niobium tantalum, chromium, molybdenum, tungsten, manganese, iron, ruthenium, cobalt, nickel, copper, zinc, cadmium, silver, aluminum ($Al^{3+}$), each present in an amount of from about 0.1 to about 10 weight percent of the toner components, and preferably from about 0.5 to about 5 weight percent of the toner.

Examples of polyester resins are as indicated herein and in the appropriate U.S. patents recited, and more specifically, examples of a number of polyesters are the beryllium salt of copoly (1,2-propylene-dipropylene-5-sulfoisophthalate)-copoly (1,2-propylene-dipropylene terephthalate), the barium salt of copoly (1,2-propylene-diethylene-5-sulfoisophthalate)-copoly (1,2-propylene-diethylene terephthalate), the magnesium salt of copoly (1,2 dipropylene-5-sulfoisophthalate)-copoly (1,2-propylene terephthalate), the magnesium salt of copoly (1,3-butylene-5-sulfoisophthalate)-copoly (1,3-butylene terephthalate), the calcium salt of copoly (1,2 dipropylene-5-sulfoisophthalate)-copoly (1,2-propylene terephthalate), the calcium salt of copoly (1,3-butylene-5-sulfoisophthalate)-copoly (1,3-butylene terephthalate), the cobalt salt of copoly (1,2-propylene-diethylene-5-sulfoisophthalate)-copoly (1,2-propylene-diethylene terephthalate), the nickel salt of copoly (1,2 dipropylene-5-sulfoisophthalate)-copoly (1,2-propylene terephthalate), the iron salt of copoly (1,3-butylene-5-sulfoisophthalate)-copoly (1,3-butylene terephthalate), the zirconium salt of copoly (1,2 dipropylene-5-sulfoisophthalate)-copoly (1,2-propylene terephthalate), the chromium salt of copoly (1,3-butylene-5-sulfoisophthalate)-copoly (1,3-butylene terephthalate) and the like.

Examples of tetra-alkylated ammonium or phosphonium salts include benzyldimethylstearylammonium chloride, dimethyidistearyl ammonium bromide, stearyltributylphosphonium bromide, tetraphenylphosphonium bromide, and tetrabutylphosphonium bromide, the halide (fluoride, chloride, bromide, or iodide), acetate, phosphate, sulfate, or alkylsulfonate salts of tetra-alkylated ammonium or tetra-alkylated phosphonium compounds with C1 to C20 alkyl substituents, such as methyl, ethyl, propyl, n-butyl, sec-butyl, tert-butyl, n-pentyl, iso-pentyl, neo-pentyl, hexyl, heptyl, octyl, nonyl, decyl, undecyl, dodecyl, or lauryl, tridecyl, tetradecyl or myristyl, pentadecyl, hexadecyl or cetyl, heptadecyl, octadecyl or stearyl, nonadecyl, eicosyl group, or mixtures thereof; and the aryl groups like phenyl, benzyl, 2-phenylethyl, naphthyl, anthracenyl, phenanthrenyl and the like.

Various known colorants, especially pigments, present in the toner in an effective amount of, for example, from about 1 to about 65, and preferably from about 2 to about 35 percent by weight of the toner, and more preferably in an amount of from about 1 to about 15 weight percent and wherein the total of all toner components is about 100 percent, include carbon black like REGAL 330®; magnetites such as Mobay magnetites MO8029™, MO8060™; and the like. As colored pigments, there can be selected known cyan, magenta, yellow, red, green, brown, blue or mixtures thereof. Specific examples of colorants, especially pigments, include phthalocyanine HELIOGEN BLUE L6900™, D6840™, D7080™, D7020™, cyan 15:3, magenta Red 81:3, Yellow 17, the pigments of U.S. Pat. No. 5,556,727, the disclosure of which is totally incorporated herein by reference, and the like.

Examples of specific magentas that may be selected include, for example, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of specific cyans that may be selected include copper tetra(octadecyl sulfonamido) phthalocyanine, x-copper phthalocyanine pigment listed in the Color Index as CI 74160, CI Pigment Blue, and Anthrathrene Blue, identified in the Color Index as CI 69810, Special Blue X-2137, and the like; while illustrative specific examples of yellows that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL. Colored magnetites, such as mixtures of MAPICO BLACK™, and cyan components may also be selected as pigments with the process of the present invention. The colorants, such as pigments, selected can be flushed pigments as indicated herein.

More specifically, colorant examples include Pigment Blue 15:3 having a Color Index Constitution Number of 74160, magenta Pigment Red 81:3 having a Color Index Constitution Number of 45160:3, and Yellow 17 having a Color Index Constitution Number of 21105, and known dyes such as food dyes, yellow, blue, green, red, magenta dyes, and the like. Colorants include pigments, dyes, mixtures of pigments, mixtures of dyes, and mixtures of dyes and pigments, and the like, and preferably pigments.

Dry powder additives that can be added or blended onto the surface of the toner compositions preferably after washing or drying include, for example, metal salts, metal salts of fatty acids, colloidal silicas, metal oxides like titanium, tin and the like, mixtures thereof and the like, which additives are each usually present in an amount of from about 0.1 to about 2 weight percent, reference U.S. Pat. Nos. 3,590,000; 3,720,617; 3,655,374 and 3,983,045, the disclosures of which are totally incorporated herein by reference. Preferred additives include zinc stearate and flow aids, such as fumed silicas like AEROSIL R9725® available from Degussa, or silicas available from Cabot Corporation or Degussa Chemicals, the coated silicas of copending applications U.S. Ser. No. 09/132,623 pending and U.S. Ser. No. 09/132,188, now U.S. Pat. No. 6,004,714 and the like, each in amounts of from about 0.1 to about 2 percent, which can be added during the aggregation process or blended into the formed toner product.

Developer compositions can be prepared by mixing the toners with known carrier particles, including coated carriers, such as steel, ferrites, and the like, reference U.S. Pat. Nos. 4,937,166 and 4,935,326, the disclosures of which are totally incorporated herein by reference, for example from about 2 percent toner concentration to about 8 percent toner concentration.

Imaging methods are also envisioned with the toners of the present invention, reference for example a number of the patents mentioned herein, and U.S. Pat. No. 4,265,990, the disclosure of which is totally incorporated herein by reference.

The following Examples are being submitted to further define various species of the present invention. These Examples are intended to be illustrative only and are not intended to limit the scope of the present invention. Also, parts and percentages are by weight unless otherwise indicated.

Preparation Of Sodio Sulfonated Polyesters:

A linear sulfonated random copolyester resin comprised of, on a mol percent, 0.465 of terephthalate, 0.035 of sodium sulfoisophthalate, 0.475 of 1,2-propanediol, and 0.025 of diethylene glycol was prepared as follows. In a 5 gallon Parr reactor equipped with a bottom drain valve, double turbine agitator, and distillation receiver with a cold water condenser were charged 3.98 kilograms of dimethylterephthalate, 451 grams of sodium dimethyl sulfoisophthalate, 3.104 kilograms of 1,2-propanediol (1 mole excess of glycol), 351 grams of diethylene glycol (1 mole excess of glycol), and 8 grams of butyltin hydroxide oxide catalyst. The reactor was then heated to 165° C. with stirring for 3 hours whereby 1.33 kilograms of distillate were collected in the distillation receiver, and which distillate was comprised of about 98 percent by volume of methanol and 2 percent by volume of 1,2-propanediol as measured by the ABBE refractometer available from American Optical Corporation. The reactor mixture was then heated to 190° C. over a one hour period, after which the pressure was slowly reduced from atmospheric pressure to about 260 Torr over a one hour period, and then reduced to 5 Torr over a two hour period with the collection of approximately 470 grams of distillate in the distillation receiver, and which distillate was comprised of approximately 97 percent by volume of 1,2-propanediol and 3 percent by volume of methanol as measured by the ABBE refractometer. The pressure was then further reduced to about 1 Torr over a 30 minute period whereby an additional 530 grams of 1,2-propanediol were collected. The reactor was then purged with nitrogen to atmospheric pressure, and the polymer product discharged through the bottom drain onto a container cooled with dry ice to yield 5.60 kilograms of 3.5 mol percent sulfonated polyester resin, sodio salt of (1,2-propylene-dipropylene-5-sulfoisophthalate)-copoly (1,2-propylene-dipropylene terephthalate). The sulfonated polyester resin glass transition temperature was measured to be 56.6° C. (onset) utilizing the 910 Differential Scanning Calorimeter available from E.I. DuPont operating at a heating rate of 10° C. per minute. The number average molecular weight was measured to be 3,250 grams per mole, and the weight average molecular weight was measured to be 5,290 grams per mole using tetrahydrofuran as the solvent.

Preparation of a Sodio Sulfonated Polyester Colloid Solution:

A 15 percent solids concentration of colloidal sulfonate polyester resin dissipated in aqueous media was prepared by first heating about 2 liters of deionized water to about 85° C. with stirring, and adding thereto 300 grams of the sulfonated polyester resin obtained above, followed by continued heating at about 85° C., and stirring of the mixture for a duration of from about one to about two hours, followed by cooling to about room temperature, about 25° C. throughout the Examples. The colloidal solution of sodio-sulfonated polyester resin particles possessed a characteristic blue tinge and particle sizes in the range of from about 5 to about 150 nanometers, and typically in the range of 20 to 40 nanometers, as measured by the NiCOMP® particle sizer.

EXAMPLE

A 5 Micron Cyan Non-Surface-Treated Toner Comprised of a Linear Sulfonated Polyester Core Resin and Pigment Blue 15:3 Colorant:

A 2 liter colloidal solution containing 15 percent by weight of the sodio sulfonated polyester resin of Example I was charged into a 4 liter kettle equipped with a mechanical stirrer. To this was added 42 grams of a cyan pigment dispersion containing 30 percent by weight of Pigment Blue 15:3 (available from Sun Chemicals), and the resulting mixture was heated to 56° C. with stirring at about 180 to 200 revolutions per minute. To this heated mixture was then added dropwise 760 grams of an aqueous solution containing 5 percent by weight of zinc acetate dihydrate. The dropwise addition of the zinc acetate dihydrate solution was accomplished utilizing a peristaltic pump, at a rate of addition of approximately 2.5 milliliters per minute. After the addition was complete (about 5 hours), the mixture was stirred for an additional 3 hours. A sample (about 1 gram) of the reaction mixture was then retrieved from the kettle, and a particle size of 4.9 microns with a GSD of 1.18 was measured by the Coulter Counter. The mixture was then allowed to cool to room temperature, about 25° C., overnight, about 18 hours, with stirring. The product was filtered off through a 3 micron hydrophobic membrane cloth, and the toner cake was reslurried into about 2 liters of deionized water and stirred for about 1 hour. The toner slurry was refiltered and the cake redispersed into about 1.5 liters of deionized water, to provide a final slurry concentration of about 20 percent toner solids. The toner slurry had a conductivity of about 150 microsiemens per centimeter, and was set aside for chemical surface treatment as specifically described in Examples I to III.

EXAMPLE I

Chemical Surface Treatment of a 5 Micron Cyan Toner with 0.5 Percent by Weight of Stearyltributylphosphonium Bromide (STBP-Br)

A 500 gram portion of the cyan 5 micron toner slurry prepared in the Example above, which contained 20 percent toner solids, or 100 grams of toner, was subjected to chemical surface treatment with stearyltributylphosphonium bromide (STBP-Br) at a concentration of 0.5 percent by weight of toner solids. The amount of STBP-Br salt for 0.5 percent surface treatment was 0.5 gram, which was delivered as a 1 percent (wt/wt) solution of STBP-bromide in deionized water. The STBP-Br aqueous solution was prepared by mixing 0.5 gram of STBP-bromide into 50 millimeters of deionized water (DIW) and heating to 50° C. to aid dissolution. Once dissolved, the STBP solution was cooled to room temperature (about 25° C.). A sample of toner slurry containing 100 grams of cyan 5 micron toner solids in 500 grams of water was charged into a 2 liter resin kettle and was mechanically stirred at 200 to 220 rpm and heated to 52° C. at a heating rate of about 0.75° C./minute. Once at 52° C., the STBP-Br aqueous solution was added dropwise to the toner slurry at an approximate rate of 1 milliliter per minute. The slurry resulting was subsequently stirred for an additional 30 minutes, and then cooled to room temperature. The cooled surface-treated toner slurry was first sieved through a 25 micron stainless steel screen (#500 mesh), and then filtered through a 3 micron hydrophobic membrane cloth. The resulting toner cake was then reslurried into 0.5 to 1.0 liter of deionized water, stirred for 30 minutes, then filtered again. The solution conductivity of the filtrate was measured to be about 30 microsiemens per centimeter which indicated that the washing procedure was sufficient. (Typically, when the filtrate conductivity was measured to be less than or equal to 50 microsiemens per centimeter, the washing/filtering procedures were terminated.) The surface-treated toner cake was redispersed into 500 milliliters of deionized water, and freeze-dried over 48 hours. The final dry yield of chemically STBP-Br treated toner was measured to be 106 grams. The dry toner had a glass transition temperatures of 53° C. (onset), 56° C. (midpoint), and 60° C. (offset). The theoretical maximum amount of elemental phosphorous for the surface-treated toner sample was calculated to be 0.0289 percent weight (which corresponds to a theoretical maximum amount of STBP-Br of 0.5 percent weight in the sample). Phosphorus analysis of the surface-treated toner sample found 0.0177 percent-weight of elemental phosphorus (which corresponds to 0.31 percent STBP-Br).

EXAMPLE II

Chemical Surface Treatment of 5 Micron Cyan Toner with 0.5 Percent by Weight of Dimethyldistearylammonium Bromide (DMDS-Br)

A 950 gram slurry of a cyan 5 micron toner which contained about 10.5 percent toner solids, or, 100 grams of toner, was subjected to chemical surface treatment with dimethyldistearylammonium bromide (DMDS-Br) at a concentration of 0.5 percent by weight of toner solids. The amount of DMDS-Br salt for 0.5 percent surface treatment was 0.5 gram, which was delivered as a 1 percent (wt/wt) solution in deionized water (DIW). The DMDS-Br aqueous solution was prepared by vigorously mixing 0.5 gram of DMDS-Br into 50 milliliters of DIW, heating to 55° C. to aid dissolution, and maintaining that temperature. The toner slurry containing 100 grams of cyan 5 micron toner solids in 950 grams of water was charged into a 2 liter resin kettle and was mechanically stirred at about 250 rpm and gradually heated to 52° C. Once at 52° C., the heated DMDS-Br aqueous solution was added dropwise to the toner slurry at an approximate rate of 2 to 3 milliliters per minute. The slurry was subsequently stirred for an additional 30 minutes, and then cooled to room temperature. The cooled surface-treated toner slurry was first sieved through a 25 micron stainless steel screen (#500 mesh), and then filtered through a 3 micron hydrophobic membrane cloth. The toner cake was then reslurried into 1.0 liter of deionized water, stirred for 30 minutes, then filtered again. The surface-treated toner cake was redispersed into about 500 milliliters of deionized water, and freeze-dried over 48 hours. The dry DMDS-Br treated toner possessed a glass transition temperatures of 53° C. (onset), 56° C. (midpoint), and 60° C. (offset).

EXAMPLE III

Chemical Surface Treatment of 5 Micron Cyan Toner with 0.5 Percent by Weight of Benzyldimethylstearylammonium Chloride (BMSA-Cl) A 550 gram slurry of a cyan 5 micron toner which contained about 14 percent toner solids (solids refers to toner resin, colorant, and organic cation), or 75 grams of toner, was subjected to chemical surface treatment with benzyldimethylstearylammonium chloride BMSA-Cl at a concentration of approximately 0.5 percent by weight of toner solids. The required amount of BMSA-Cl salt for 0.5 percent surface treatment was 0.4 grams, which was delivered as a 1 percent (wt/wt) solution in deionized water (DIW). The aqueous solution was prepared by vigorously mixing 0.4 gram of BMSA-Cl into 40 milliliters of DIW, heating to 55° C. to aid dissolution, and maintaining that temperature. The toner slurry containing 75 grams of cyan 5 micron toner solids in 550 grams of water was charged into a 2 liter resin kettle and was mechanically stirred at about 250 rpm and gradually heated to 52° C. Once at 52° C., the heated BMSA-Cl aqueous solution was added dropwise to the toner slurry at an approximate rate of 1 milliliter per minute. The slurry was subsequently stirred for an additional 30 minutes, and then cooled to room temperature. The cooled surface-treated toner slurry was first sieved through a 25 micron stainless steel screen (#500 mesh), and then filtered through a 3 micron hydrophobic membrane cloth. The toner cake was then reslurried into 0.5 liter of deionized water, stirred for 30 minutes, then filtered again. The surface-treated toner cake was redispersed into about 300 milliliters of deionized water, and freeze-dried over 48 hours to afford about 65 grams of dry chemically BMSA-Cl treated toner. The dry toner had glass transition temperatures of 55° C. (onset), 60° C. (midpoint), and 65° C. (offset).

Triboelectric Charging Properties:

Developers were prepared by mixing each of the above toners with a 65 micron Hoaganese steel core coated with 1 percent by weight of a composite of a polymer of PMMA (polymethylmethacrylate with the conductive carbon black, CONDUCTEX SC ULTRA®, dispersed therein, about 20 weight percent) and conditioned overnight (about 18 hours) at 20 percent and 80 percent RH and charged for 30 minutes on a roll mill. For 5 to 6 micron toners, the toner concentration was 4 percent by weight of carrier. Triboelectric charge was measured by the Faraday Cage blow-off technique, and the charging results for the nontreated toner described in the Example above and chemically surface-treated toners described in Examples I to III are shown in Table 1. The surface-treated toners exhibited up to a two-fold improvement in the charge levels at 20 percent RH and up to a 4-fold improvement in the charge levels at 80 percent RH, thereby causing the RH sensitivity (the ratio of charge level at 20 percent RH versus 80 percent RH) to significantly diminish by about a factor of two. The enhanced tribocharge levels and minimized RH sensitivities observed for the chemically surface-treated toners in Examples I to III (evaluated without the use of external flow additives) are of importance for optimum performance within a developer blend.

TABLE I

| Toner ID | Chemical Surface Treatment | q/m, μCoul/g (20% RH) | q/m, μCoul/g (80% RH) | q/m RH ratio | q/d, fCoul/μg (20% RH) | q/d, fCoul/μg (80% RH) | q/d RH ratio |
|---|---|---|---|---|---|---|---|
| Example | none | −47.6 | −9.2 | 5.2 | −0.41 | −0.09 | 4.6 |
| Example I | 0.5 percent STBP-Br | −87.1 | −33.3 | 2.6 | −0.55 | −0.19 | 2.9 |
| Example II | 0.5 percent DMDO-Br | −38.3 | −29.7 | 1.3 | −0.63 | −0.19 | 4.5 |
| Example III | 0.5 percent BMSA-Cl | −62.6 | −21.3 | 2.9 | −0.36 | −0.17 | 2.1 |

Fusing Properties:

Samples of the toners of the above Example and Examples I to III were additionally chemically surface-treated with tetra-alkylated quaternary ammonium, phosphonium salts such as STBP-Br, DMDS-Br, or BMSA-Cl, and were then prepared as unfused images produced at 0.55 mg/cm$^2$ toner mass per unit area (TMA) on Xerox® Color Xpressions (CX) paper, using a modified MITA copier. Dry powder surface additives were blended for about 10 seconds using an SKM mill onto the surfaces of each of the toners to improve flow for developability: 0.5 Percent by weight of the toner of AEROSIL R812® (a surface-modified silica additive from Degussa AG) was used for the nonsurface treated toner of the above Example; 0.1 percent by weight of toner of AEROSIL R812® was used for the STBP-Br treated toner of Example I; 0.1 percent by weight of toner of AEROSIL R812® was used for the DMDS-Br treated toner of Example II; and 0.5 percent by weight of toner of AEROSIL R812® was used for the BMSA-Cl treated toner of Example III. The unfused images were subsequently fused on a universal fusing fixture, wherein the fuser roll LB13 was comprised of an 8 micron thick outer layer of VITON®, a 42 micron thick middle layer of $Al_2O_3$-loaded VITON®, and a 2 millimeter thick inner layer of silicone rubber which rests on a 4 inch diameter core. Nip dwell time was 22 msec for images fused with toners of the above Example, Example I and Example III, while nip dwell time was 30 msec for images fused from the toner of Example II. The pressure roll temperature was kept constant at 97° C. while the fuser roll temperature varied from 120° C. to 210° C. An amino fuser oil was applied to the roll and the average oil rate on top of the sheet varied from 5.0 to 10.0 mg/copy (see Table II).

TABLE II

| Toner ID | Chemical Surface Treatment | Blended Dry Powder Additive (for flow), weight percent of toner | Peak Gloss (at 165° C.) $G_{max}$ | Temp at Gloss-50 $T_{G50}$ (° C.) | MFT (Crease-30) (° C.) | MFT (Crease-60) (° C.) | ΔMFT* (Crease-60) (° C.) | Hot Offset (HOT), ° C. |
|---|---|---|---|---|---|---|---|---|
| Example | none | 0.5 percent R812 | 75 | 154 | 147 | 141 | 0 | >210 |
| Example I | 0.5 percent STBP-Br | 0.1 percent R812 | 67 | 151 | 141 | 134 | −7 | >210 |
| Example II | 0.5 percent DMDS-Br | 0.1 percent R812 | 75 | 135 | 139 | 134 | −7 | >210 |
| Example III | 0.5 percent BMSA-Cl | 0.5 percent R812 | 70 | 152 | 149 | 143 | +2 | >210 |

*Relative to MFT (Crease-60) of toner from Comparative Example.
For the Example Toner above with a zero MFT: TMA = 0.55 mg/cm$^2$, dwell time = 22 ms, Top oil rate = 5.0 mg/copy, CX paper
For Example I Toner: TMA = 0.55 mg/cm$^2$. dwell time = 22 ms, Top oil rate = 7.8 mg/copy, CX paper
For Example II Toner: TMA = 1.0 mg/cm$^2$, dwell time = 30 ms, Top oil rate = 10.0 mg/copy, CX paper
For Example III Toner: TMA = 0.55 mg/cm$^2$, dwell time = 22 ms, Top oil rate = 5.0 mg/copy, CX paper The results for peak gloss ($G_{max}$) values, shown in Table II, are high for each of the toners, ranging from 67 to 75 gloss units. The results for minimum fusing temperature (MFT) based on the crease area (either 30 or 60 units) are also summarized in Table II, and typically, are accurate to ±5° C. The values for MFT were found to range from about 134° C. to about 149° C. The toners in Examples I and II, which were chemically surface-treated with, respectively, 0.5 percent by weight STBP-Br and 0.5 percent by weight DMDS-Br, possess lower MFT values (as illustrated in Table II under the column ΔMFT) than what was observed for the nontreated toner from the above Example. For the toner in Example III, which was chemically surface-treated with 0.5 percent by weight BMSA-Cl, the MFT value was only about 2° C. higher than for the untreated toner in the above Example. Furthermore, since all the toners displayed a Hot Offset value of greater than 210° C., the fusing latitudes for each of these toners, which is the difference between the Hot Offset temperature (HOT) and the minimum Fusing Temperature (MFT), are fairly wide, with values in the range of from about 61 to 71° C. (based on crease area=30 results) and from about 67° C. to 76° C. (based on crease area=60 results). Consequently, the chemical surface-treatment of sodio-sulfonated polyester toners with about 0.5 percent by weight of either STBP-Br, DMDS-Br or BMSA-Cl, does not adversely affect the fusing properties when compared to a nonsurface treated parent toner of the same composition.

Additional unfused images at TMA of 0.55 mg/cm$^2$ were prepared from toners of the above Example and Example I, for vinyl offset evaluation. The same concentration of AEROSIL R812® dry powder additive blends were used, 0.5 percent by weight for the toner of the above Example and 0.1 percent by weight for the toner of Example I. Samples were fused during a separate fusing run where all fusing parameters were fixed, and were the same as described above except that the fuser roll temperature was fixed at 155° C. The fused solid area images were cut out and mounted on a 8.5 inches×11 inches sheet for vinyl offset measurements. Each sample was covered by a slightly larger piece of Fuji Xerox standard vinyl. The sample sheets were placed between glass plates and weighted down with three reams of paper and placed in an oven at 50° C. After 48 hours, the vinyl strips were peeled from the toner image and mounted on another 8.5 inches×11 inches sheet. The amount of vinyl offset for each toner was quantitatively measured using the percent-area of the vinyl strip which has offset toner adhering to it. Two to four samples were run for each toner, and the average vinyl offset was calculated (see Table III).

For the above Example toner, the average percent-vinyl offset was found to be small at 0.03 percent. The percent-vinyl offset is also small for the toner of Example I, which was chemically surface-treated with 0.5 percent-by weight of STBP-Br. Therefore, the chemical surface treatment of sodio-sulfonated polyester-based toners with about 0.5 percent by weight of STBP-Br does not adversely affect vinyl offset properties when compared to nonsurface treated parent toner of the same composition.

TABLE III

| Toner ID | Chemical Surface Treatment | Dry powder Additive Blended onto Toner | Toner Tg (onset/midpt) | Average Percent-Vinyl Offset (50° C., 48 hr) |
|---|---|---|---|---|
| Example | none | 0.5 percent R812 | 56° C./61° C. | 0.03 |
| Example I | 0.5 percent STBP-Br | 0.1 percent R812 | 53° C./58° C. | 0.07 |

For each Example: TMA=0.55 mg/cm$^2$, dwell=22 ms, Top oil rate=7–9 μL/copy

Other embodiments and modifications of the present invention may occur to those skilled in the art subsequent to a review of the information presented herein, these embodiments and modifications, as well as equivalents thereof, are also included within the scope of this invention.

What is claimed is:

1. A toner comprised of a sulfonated polyester resin, colorant, and thereover a quaternary organic component ionically bound to the toner surface.

2. A toner in accordance with claim 1 wherein said quaternary organic component is a cation of a tetra-alkylated ammonium salt or a tetra-alkylated phosphonium salt.

3. A toner in accordance with claim 1 wherein the polyester is of the formula

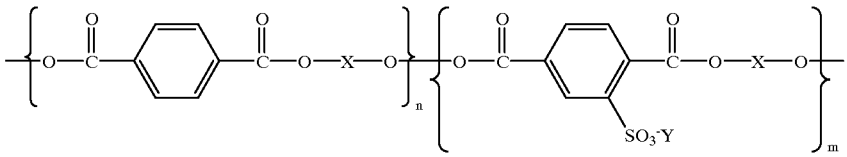

wherein Y is an alkali metal, X is a glycol, and n and m each represent the number of segments.

4. A toner in accordance with claim 1 wherein said quaternary component is a tetra-alkylated ammonium salt of benzyldimethyl-stearylammonium chloride or dimethyldistearylammonium bromide.

5. A toner in accordance with claim 1 wherein said quaternary component is a tetra-alkylated phosphonium of stearyltributyl phosphonium bromide or tetraphenyl phosphonium bromide.

6. A toner in accordance with claim 3 wherein said Y alkali is magnesium.

7. A toner in accordance with claim 3 wherein said Y metal is zinc.

8. A toner in accordance with claim 1 wherein the colorant is a cyan, black, magenta, yellow dispersion or mixtures thereof with from about 20 to about 60 weight percent of colorant solids.

9. A toner in accordance with claim 1 wherein said colorant is carbon black.

10. A toner in accordance with claim 1 wherein said colorant is a dye.

11. A toner in accordance with claim 1 wherein said colorant is a pigment.

12. A toner in accordance with claim 1 wherein said colorant is comprised of cyan, yellow, magenta, black, green, orange, violet or brown, and wherein each colorant is present in an amount of from about 2 weight percent to about 20 weight percent of the toner.

13. A toner in accordance with claim 1 wherein said toner contains blended dry powder additives on the toner surface, and which additives are comprised of metal salts, metal salts of fatty acids, colloidal silicas, metal oxides, or mixtures thereof, and which additives are each optionally present in an amount of from about 0.1 to about 2 weight percent.

14. A toner in accordance with claim 3 wherein said glycol is an aliphatic glycol of neopentyl glycol, ethylene glycol, propylene glycol, butylene glycol, pentylene glycol, propanediol, 1,2-propanediol, diethylene glycol, dipropylene glycol, or mixtures thereof; and n and m each represent a number of from about 10 to about 30, and wherein the weight average molecular weight of said polyester is from about 2,000 grams per mole to about 100,000 grams per mole, the number average molecular weight is from about 1,000 grams per mole to about 50,000 grams per mole, and the polydispersity thereof is from about 2 to about 18 as measured by gel permeation chromatography.

15. A toner process comprising (i) preparing a colloidal solution of a sulfonated polyester resin by heating water at a temperature of from about 75° C. to about 95° C., adding thereto a sulfonated polyester resin, and cooling; (ii) adding thereto a colorant, followed by heating the resulting mixture to a temperature equal to or higher than the resin glass transition temperature; (iii) adding thereto an aqueous solution of either an alkaline earth metal (II) salt or a transition metal salt whereby the coalescence and ionic complexation of sulfonated polyester colloid, colorant, and metal cation occur until the particle size of the composite is about 3 to about 10 microns in volume-average diameter with a geometric distribution of from about 1.13 to about 1.23, wherein said wet toner solids of about 3 to about 10 microns in size are redispersed in water forming a slurry of about 15 to about 25 percent by weight of toner solids; (iv) followed by chemically treating toner particles in the heated aqueous slurry at temperatures of about 25° C. to about 60° C. with an aqueous solution containing about 0.1 to about 5 percent by weight of toner of a tetra-alkylated ammonium or tetra-alkylated phosphonium salt.

16. A process in accordance with claim 15 wherein said toner is isolated, filtered, washed with water, and dried.

17. A toner in accordance with claim 1 wherein the polyester is present in an amount of from about 80 to about 98 percent by weight of the toner, the colorant is present from an amount of from about 2 to about 20 weight percent of the toner, and the quaternary organic component is present in an amount of from about 0.1 to about 5 weight percent of the toner.

18. A toner in accordance with claim 1 wherein said quaternary component is a salt and forms a surface layer on said resin and said colorant.

19. A toner in accordance with claim 18 wherein said surface layer is of a thickness of from about 0.01 to about 0.2 micron.

20. A toner in accordance with claim 1 wherein said polyester resin contains from about 0.1 to about 5.0 weight percent of sulfonated groups.

21. A toner in accordance with claim 2 wherein said tetra-alkylated phosphonium is of the formula

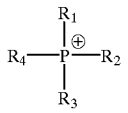

wherein $R_1$, $R_2$, $R_3$, and $R_4$ are each independently alkyl or aryl.

22. A toner in accordance with claim 2 wherein said tetra-alkylated ammonium is of the formula

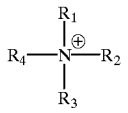

wherein $R_1$, $R_2$, $R_3$, and $R_4$ are independently alkyl or aryl.

23. A toner in accordance with claim 2 wherein said salt is stearyltributylphosphonium bromide, tetraphenylphosphonium bromide, distearyidibutylphosphonium bromide, stearyltriethyl phosphonium bromide or butyltriphenylphosphonium bromide.

24. A toner in accordance with claim 2 wherein said salt is benzyldimethylstearylammonium chloride, stearyltributylammonium bromide, tetraphenylammonium bromide, distearyldimethylammonium bromide, stearyltriethylammonium bromide or butyltriphenylphosphonium bromide.

25. A toner in accordance with claim 2 wherein said salt is present in an amount of from about 0.1 to about 5 weight percent of the toner.

26. A toner in accordance with claim 2 wherein said salt is present in an amount of from about 0.1 to about 5 weight percent of the toner.

27. A toner in accordance with claim 22 wherein said salt primarily functions to enhance the triboelectric charge and reduce the toner relative humidity sensitivity.

28. A toner in accordance with claim 23 wherein said salt primarily functions to enhance the triboelectric charge and reduce the relative humidity sensitivity.

29. A toner comprised of a colorant and a polyester quatemary cation of the formula

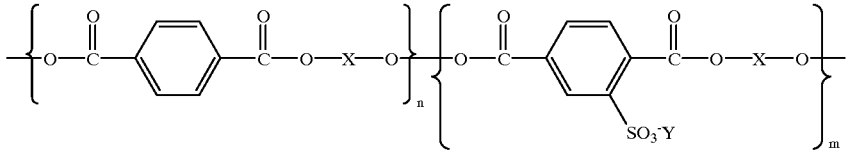

wherein Y is

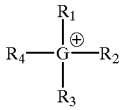

wherein each R is alkyl or aryl; G is nitrogen or phosphorus; X is a glycol or is generated from glycol; and m and n represent the number of segments.

30. A toner comprised of a sulfonated polyester resin, colorant and thereover a quaternary organic cation ionically bound to the toner surface, and wherein said polyester/cation is of the formula

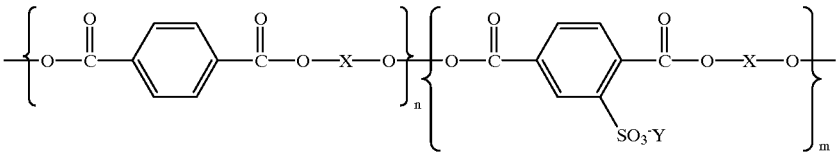

wherein Y is

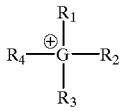

wherein each R is alkyl or aryl; G is nitrogen or phosphorus; X is a glycol or is generated from glycol; and m and n represent the number of segments.

31. A toner in accordance with claim 29 wherein Y is a metal ion.

32. A process for the preparation of toner which comprises admixing colorant, polyester and a quaternary organic cation to enable the attachment of said cation to said polyester.

33. A process in accordance with claim 32 wherein said polyester is a sulfonated polyester.

* * * * *